US011469543B2

(12) United States Patent
Miyayama et al.

(10) Patent No.: US 11,469,543 B2
(45) Date of Patent: Oct. 11, 2022

(54) FITTING STRUCTURE FOR ELECTRICAL CONNECTION PART

(71) Applicant: TOYO DENSO KABUSHIKI KAISHA, Tokyo (JP)

(72) Inventors: Shingo Miyayama, Tsurugashima (JP); Daisuke Motoki, Tsurugashima (JP)

(73) Assignee: TOYO DENSO KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/383,487

(22) Filed: Jul. 23, 2021

(65) Prior Publication Data

US 2022/0037831 A1 Feb. 3, 2022

(30) Foreign Application Priority Data

Jul. 28, 2020 (JP) ..... JP2020-127297

(51) Int. Cl.
*H01R 13/506* (2006.01)
*H01R 13/52* (2006.01)

(52) U.S. Cl.
CPC ..... *H01R 13/5213* (2013.01); *H01R 13/506* (2013.01); *H01R 13/521* (2013.01)

(58) Field of Classification Search
CPC . H01R 13/5213; H01R 13/506; H01R 13/521
See application file for complete search history.

(56) References Cited

U.S. PATENT DOCUMENTS 5,403,212 A * 4/1995 Aimasso ..... H01R 13/4361 439/598
9,444,179 B1 * 9/2016 Elbaz ..... H02G 3/14
10,348,030 B1 * 7/2019 Lin ..... H01R 13/64
10,801,233 B2 * 10/2020 Pedersen ..... E05B 47/0045
2009/0130875 A1 * 5/2009 Guo ..... H01R 13/447 439/141
2017/0227992 A1 * 8/2017 Yoshioka ..... H01R 13/447

FOREIGN PATENT DOCUMENTS

FR 0581320 A1 * 2/1994
JP 2009-277439 A 11/2009
JP 2014-232584 A 12/2014

* cited by examiner

*Primary Examiner* — Tho D Ta
(74) *Attorney, Agent, or Firm* — Keating and Bennett, LLP

(57) ABSTRACT

A fitting structure for an electrical connection part, includes a case body with an opening, and a cap connected to the case body turnably about a center of turning which extends substantially perpendicular to an insertion direction of an external connection terminal connected to a connection terminal housed in the case body. The case body includes a fitting portion around the opening, and a first engagement piece extending outside from the fitting portion. The cap includes a second engagement piece extending inside to engage with the first engagement piece. An extension of at least one of the first engagement piece or second engagement piece decreases in length in the direction of the center of turning, toward an end of the extension, and/or includes chamfers on the both sides of the middle position of the extension in the direction of the center of turning.

7 Claims, 7 Drawing Sheets

FITTING STRUCTURE FOR ELECTRICAL CONNECTION PART

BACKGROUND OF THE INVENTION

Field of the Invention

The present invention relates to fitting structures for electrical connection parts.

Description of the Related Art

Electrical connection parts which are mounted in vehicles and the like are known. In most cases, such an electrical connection part includes a case body that is formed with an opening for establishing a connection with an external connection terminal, and a cap that is attachable to and detachable from (a fitting portion of) the case body, as disclosed in Japanese Laid-open Patent Publication (Kokai) No. 2009-277439. In an electrical junction box having such a structure, if the case body and the cap both have a circular profile whereas the opening is rectangular, it increases the overall size of the electrical junction box. Japanese Laid-open Patent Publication (Kokai) No. 2014-232584 discloses a joint connector including a case body and a cap having a rectangular profile.

The electrical connection parts disclosed in Japanese Laid-open Patent Publication (Kokai) No. 2009-277439 and Japanese Laid-open Patent Publication (Kokai) No. 2014-232584 are configured so that the cap is turnably connected to the case body and is attached to the case body with a turning action. In some cases, in order to provide a cap with a function to prevent same from falling off from a case body, the cap and the case body are configured to engage with each other via their engagement pieces.

However, in the case of an electrical connection part configured such that the cap and the case body engage with each other via their engagement pieces and the fitting portion of the case body has a rectangular profile, the engagement pieces are subjected to a large amount of stress due to turning actions of the cap given when the cap is attached to or detached from the case body. In particular, there is a risk that, each time when the cap is detached from the case body, the engagement piece is pulled, resulting in damage near the root of the engagement piece after the cap is used for a long period of time. Hence, there is room for improvement in terms of increasing durability in repeated attaching and detaching actions of the cap while avoiding an increase in size of the electrical connection part.

SUMMARY OF THE INVENTION

One or more aspects of the present invention are directed to electrical connection parts that improve durability and avoid an increase in size thereof.

Accordingly, a fitting structure for an electrical connection part according to one aspect includes a case body and a cap. The case body houses a connection terminal and includes a substantially rectangular opening for a connection of an external connection terminal to the connection terminal. The cap covers the opening in a state of being attached to the case body and is connected to the case body attachably to and detachably from the case body so as to be turnable about a center of turning, where the center of turning extends substantially perpendicular to an insertion direction in which the external connection terminal travels toward the connection terminal. The case body further includes a fitting portion and a first engagement piece. The fitting portion is formed around the opening to enable the cap to be fitted and has a substantially rectangular outer shape when the opening is viewed from the front. The first engagement piece extends from the fitting portion in a direction of an outer periphery of the case body, to be substantially perpendicular to the insertion direction. The cap further includes a second engagement piece that extends in a direction of an inner periphery of the cap to engage with the first engagement piece. The first engagement piece includes a first extension corresponding to a side closest to the center of turning among four sides of the substantially rectangular outer shape of the fitting portion. The second engagement piece includes a second extension corresponding to the side closest to the center of turning in a state the cap being attached to the case body. The length of at least one of the first extension or the second extension in a direction of the center of turning decreases toward an end of the at least one of the first extension or the second extension in an extension direction in which the at least one of the first extension or the second extension extends.

Accordingly, a fitting structure for an electrical connection part according to another aspect includes a fitting structure for an electrical connection part according to one aspect includes a case body and a cap. The case body houses a connection terminal and includes a substantially rectangular opening for a connection of an external connection terminal to the connection terminal. The cap covers the opening in a state of being attached to the case body and is connected to the case body attachably to and detachably from the case body so as to be turnable about a center of turning, where the center of turning extends substantially perpendicular to an insertion direction in which the external connection terminal travels toward the connection terminal. The case body further includes a fitting portion and a first engagement piece. The fitting portion is formed around the opening to enable the cap to be fitted and has a substantially rectangular outer shape when the opening is viewed from the front. The first engagement piece extends from the fitting portion in a direction of an outer periphery of the case body, to be substantially perpendicular to the insertion direction. The cap further includes a second engagement piece that extends in a direction of an inner periphery of the cap to engage with the first engagement piece. The first engagement piece includes a first extension corresponding to a side closest to the center of turning among four sides of the substantially rectangular outer shape of the fitting portion. The second engagement piece includes a second extension corresponding to the side closest to the center of turning in a state the cap being attached to the case body. At least one of the first extension or the second extension includes chamfers located in in an area from a middle position to one end position of the at least one of the first extension or the second extension and in an area from the middle position to the other end position of the at least one of the first extension or the second extension, both extending in the direction of the center of turning.

According to the foregoing configuration, the durability of electrical connection parts can be improved and an increase in size thereof can be avoided.

Further features of the present invention will become apparent from the following description of exemplary embodiments with reference to the attached drawings.

DESCRIPTION OF THE EMBODIMENTS

Embodiments of the present invention will be described hereinbelow with reference to the drawings.

Figure 1:
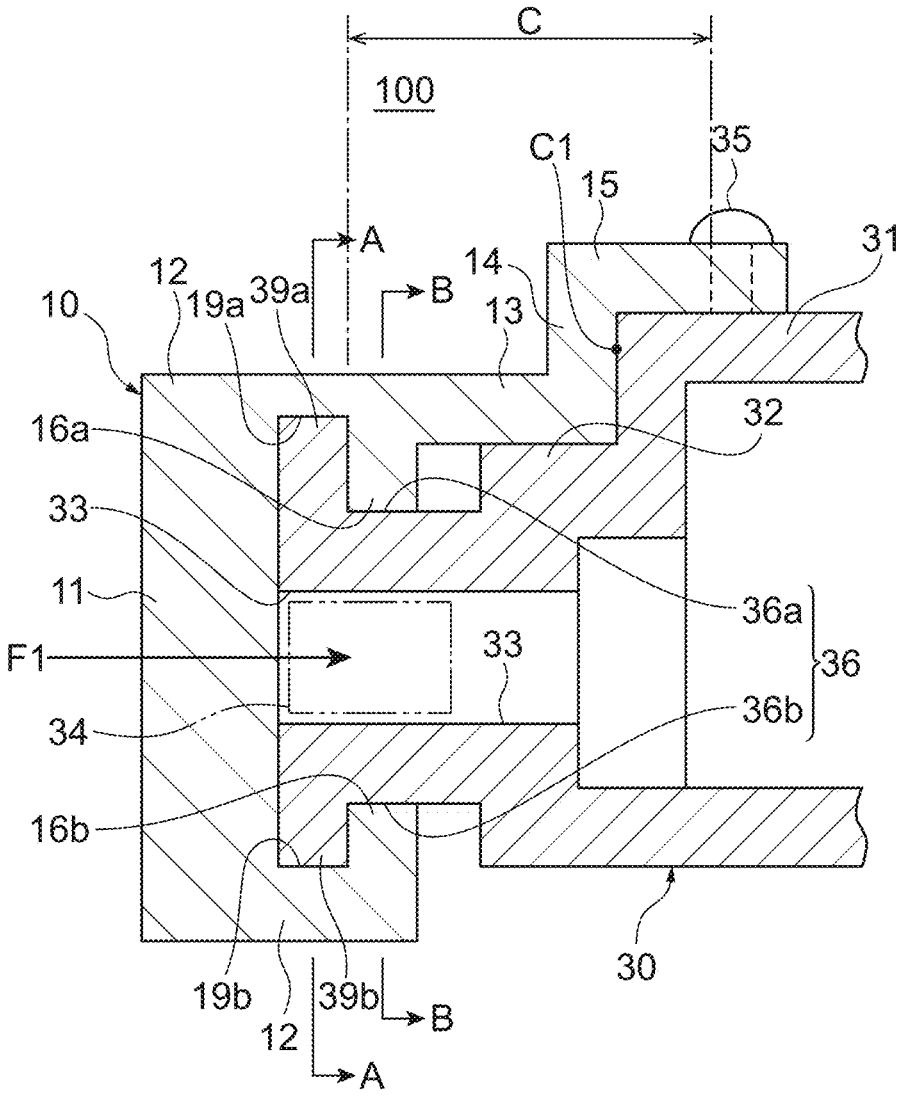
FIG. 1 is a vertical cross-sectional view of an electrical connection part.

FIG. 1 is a vertical cross-sectional view of an electrical connection part for which a fitting structure according to a first embodiment of the present invention is used. This electrical connection part 100 can be used for vehicles by way of an example, but the application target is irrelevant.

The electrical connection part 100 includes a case body 30 and a cap 10. The case body 30 is a housing with an opening 33. The case body 30 is mounted onto a vehicle such that the opening 33, which is a port, opens toward the inside of the vehicle. The case body 30 houses a connection terminal 34 inside the opening 33. The connection terminal 34 is a terminal to which an external connection terminal is connected so as to establish an electrical connection with external equipment. The connection terminal 34 can be, for example, a power supply socket, a cigar socket, or a USB terminal, or the like, but the type of the connection terminal 34 is irrelevant.

Figure 2:
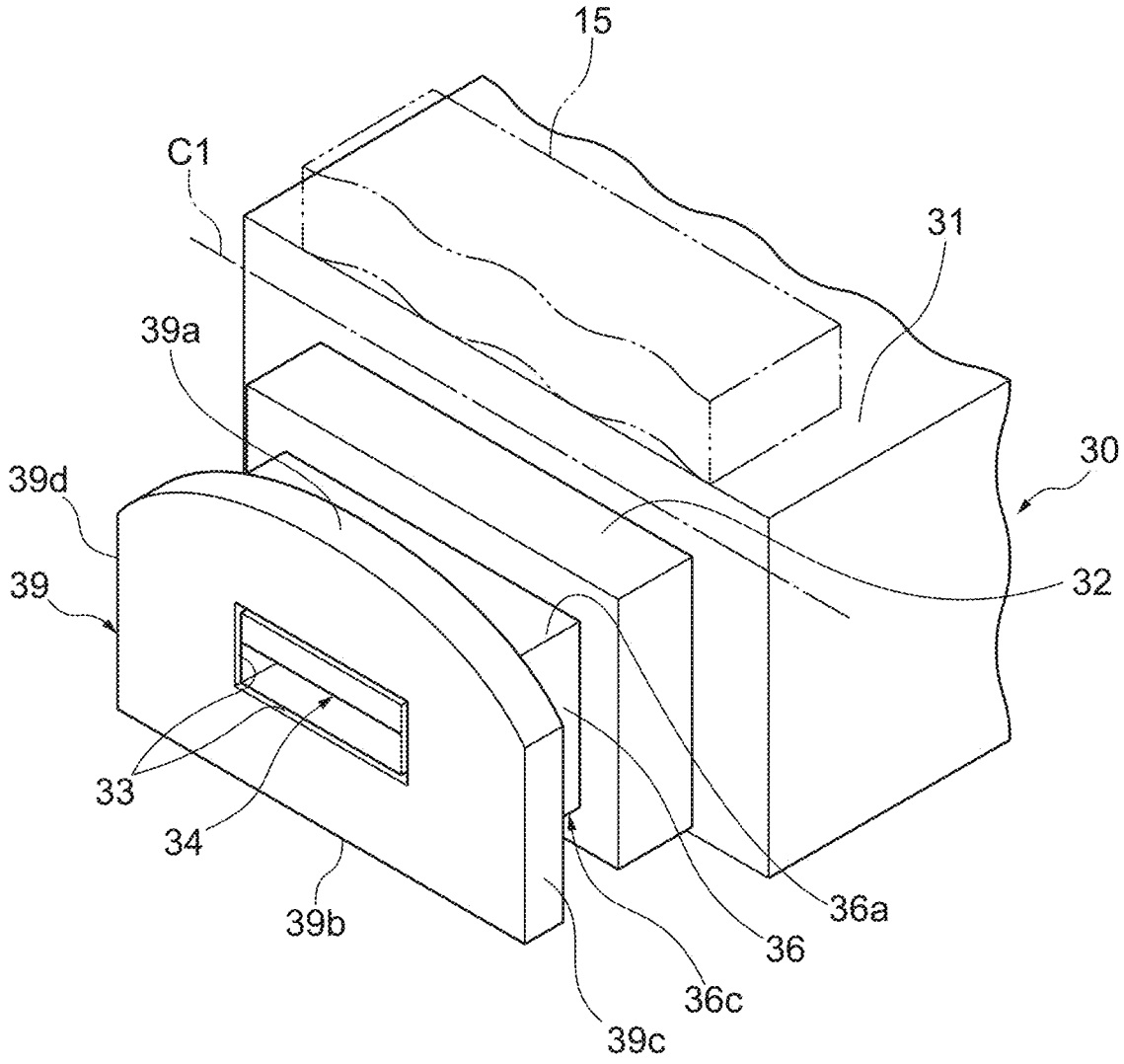
FIG. 2 is a perspective view of a case body when viewed from the opening side.
Figure 3:
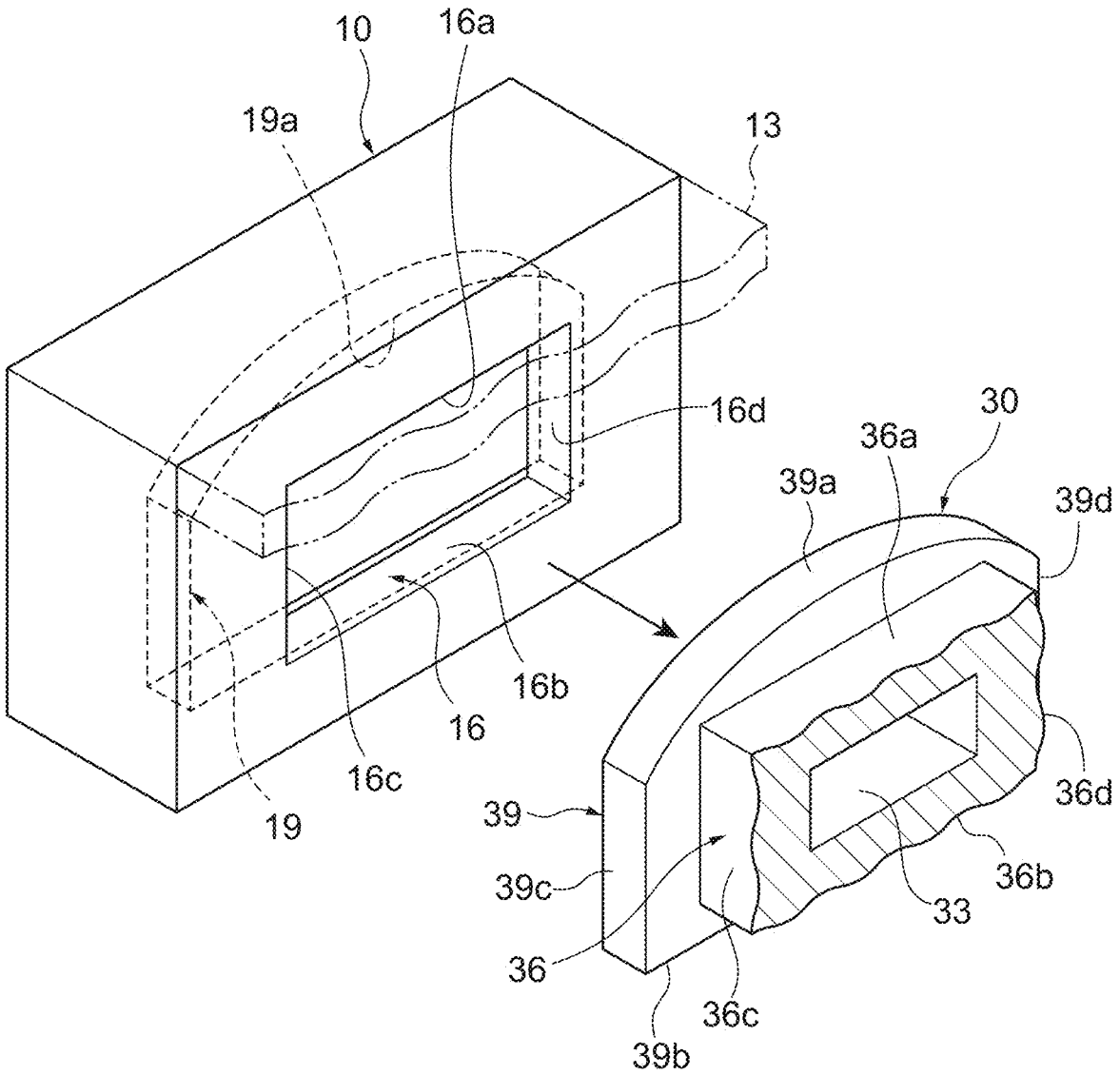
FIG. 3 is a perspective view in which a cap and the case body are separate.

FIG. 2 is a perspective view of the case body 30 when viewed from the opening 33 side. FIG. 3 is a perspective view in which the cap 10 and the case body 30 are separate.

The case body 30 is made of a resin or the like. The cap 10 is made of a resin of a higher elasticity than the case body 30 (like rubber). It should be noted that the hardness of the cap 10 and the case body 30 is not limited to or by the relationship illustrated, and that there no limitations on the raw materials of the cap or the case body.

The opening 33 in the case body 30 is provided in order to connect an external connection terminal to the connection terminal 34, and the direction of the opening is substantially parallel to the insertion direction F1 (FIG. 1) in which the external connection terminal being connected to the connection terminal 34 travels. The opening 33 is substantially rectangular when viewed from the insertion direction F1. The case body 30 includes, in a direction parallel to the insertion direction F1, a base portion 31, a step portion 32, a fitting portion 36, and a first engagement piece 39, in that order starting on the side far from the opening 33 (or in order of decreasing distance from the opening 33). For the sake of expediency in the description, suppose that the up-down direction in FIG. 1 corresponds to the up-down direction of the electrical connection part 100. Each of the top and the left and right sides of the step portion 32 is lowered by one step from the base portion 31. The fitting portion 36 is narrow in relation to both the step portion 32 and the first engagement piece 39, and is lowered by one step at the top, bottom, left and right.

The cap 10 can be fitted to the fitting portion 36, which will be described later. The outer shape of the fitting portion 36 is substantially rectangular when the opening 33 is viewed from the front (from the insertion direction F1). Similarly, the outer shapes of the base portion 31 and step portion 32 when viewed from the insertion direction F1 are also substantially rectangular. The fitting portion 36 is formed around the opening 33. The first engagement piece 39 extends from the fitting portion 36 outside or in the direction of the outer periphery of the case body 30. The first engagement piece 39 is flanged. Therefore, the first engagement piece 39 to be substantially perpendicular to the insertion direction F1, and the thickness direction of the first engagement piece 39 is substantially parallel to the insertion direction F1. The detailed shape of the first engaging piece 39 will be described later.

The cap 10 is connected to the case body 30 attachably to and detachably from the case body 30 and covers the opening 33 when attached to the case body 30 (in the attached state). FIG. 1 illustrates the cap 10 in the attached state. The cap 10 includes a fixed portion 15, a vertical connection portion 14, a horizontal connection portion 13, a peripheral wall portion 12, and a bottom wall portion 11. The fixed portion 15 is fixed to the top of the base portion 31 of the case body 30. The way to fix the fixed portion 15 is irrelevant. For example, the fixed portion 15 is fixed to the base portion 31 with a screw portion 35, which is formed in one body with the base portion 31, projecting from the base portion 31, passing through the hole formed in the fixed portion 15. Alternatively, the fixed portion 15 may be fixed by being screwed to the fixed portion 15 with a screw portion 35 that is separate from the base portion 31. Alternatively, the fixed portion 15 may be fixed by being bonded to the base portion 31.

With the fixed portion 15 fixed to the base portion 31, the cap 10 is connected to the case body 30 attachably to and detachably from the case body 30 so as to be turnable about a center of turning C1. The cap 10 further includes a second engagement piece 16 (see FIG. 3) that extends inside or in the direction of the inner periphery of the cap 10 so as to engage with the first engagement piece 39. The center of turning of the cap 10 appears in a center-of-turning region C between the second engagement piece 16 and the screw portion 35, extending in the insertion direction F1. It should be noted that the position of the center of turning may vary depending on the shape or dimensions, or the like, of the cap 10. The center of turning of the cap 10 according to this embodiment extends to be, for example, substantially perpendicular to the insertion direction F1 and substantially parallel to a long side of the fitting portion 36, as indicated by C1 in FIGS. 1 and 2. As will be described later, the cap 10 is basically opened and closed by being turnably displaced about the center of turning C1. When the cap 10 is in the attached state, same provides the connection terminal 34 with waterproofing, dustproofing, and protection functions.

As illustrated in FIG. 1, the horizontal connection portion 13 is connected to the fixed portion 15 via the vertical connection portion 14. The peripheral wall portion 12 is connected to the horizontal connection portion 13. In the attached state, the end of the peripheral wall portion 12 on the side opposite to the horizontal connection portion 13 is blocked by the bottom wall portion 11. The second engagement piece 16 extends from the peripheral wall portion 12 inside or in the direction of the inner periphery of the cap 10 (see FIG. 3). In the attached state, the second engagement piece 16 engages with the first engagement piece 39.

Figure 4A:
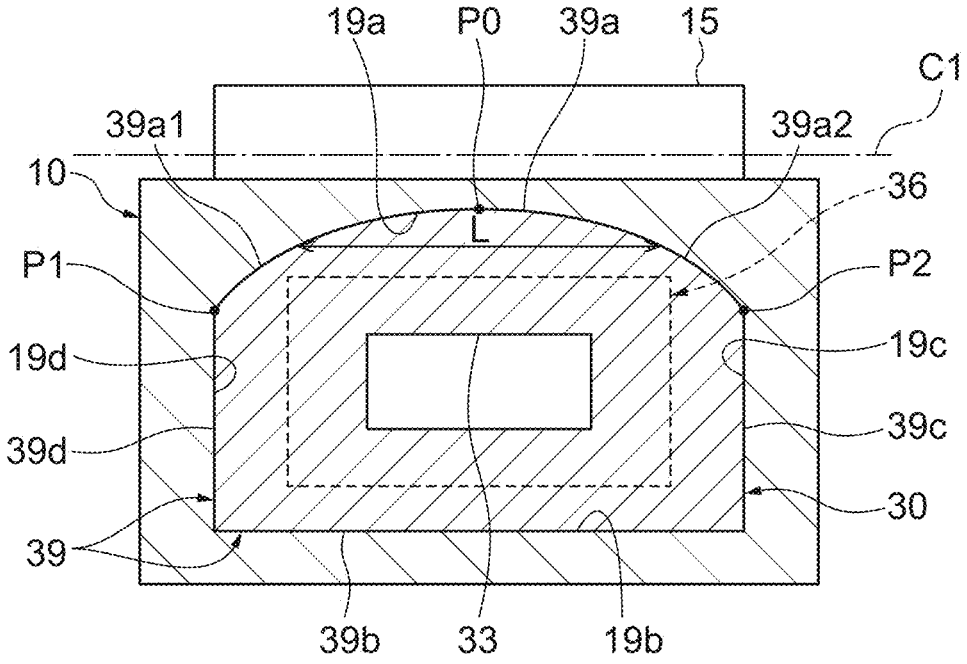
FIGS. 4A and 4B are cross-sectional views along the lines A-A and B-B of FIG. 1.
Figure 4B:
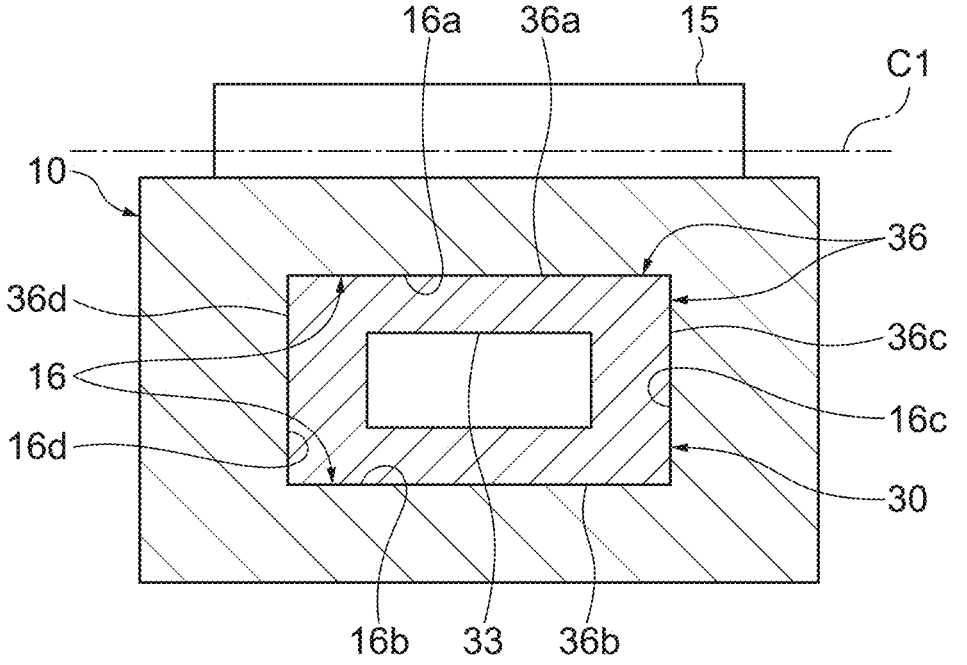

FIG. 4A is a cross-sectional view along the line A-A in FIG. 1. FIG. 4B is a cross-sectional view along the line B-B in FIG. 1.

As illustrated in FIG. 4B, the fitting portion 36 includes, as external surfaces, four surfaces 36*a*, 36*b*, 36*c*, and 36*d*.

The first surface 36*a* constitutes the upper side, or the side closest to the center of turning C1, among the four sides of the substantially rectangular outer shape of the fitting portion 36. Meanwhile, the second engagement piece 16 includes four extensions 16*a*, 16*b*, 16*c*, and 16*d*. The open shape formed by the extensions 16*a*, 16*b*, 16*c*, and 16*d* is a shape that fits the substantially rectangular shape formed by the outer shape of the fitting portion 36. In the attached state, the ends of the extensions 16*a*, 16*b*, 16*c*, and 16*d* abut against the surfaces 36*a*, 36*b*, 36*c*, and 36*d*, respectively. That is, the second engagement piece 16 abuts, over its entire periphery, against the fitting portion 36. It should be noted that the second engagement piece 16 and the fitting portion 36 need not abut against each other over their entire periphery.

As illustrated in FIG. 4A, the first engagement piece 39 includes extensions 39*a*, 39*b*, 39*c*, and 39*d*. The extension 39*a* (the first extension) mostly extends upward from the first surface 36*a*. Viewed from the insertion direction F1, the leading edges (the ends in the extension direction) of the extensions 39*b*, 39*c*, and 39*d* are linear, while the leading edge of the extension 39*a* is circular-arc-shaped. Meanwhile, an engagement-piece receiving portion 19 is formed inside the cap 10 (see also FIGS. 1 and 3). The engagement-piece receiving portion 19 includes receiving sections 19*a*, 19*b*, 19*c*, and 19*d*. The holes formed by the receiving sections 19*a*, 19*b*, 19*c*, and 19*d* are shaped to fit the first engagement piece 39. Therefore, viewed from the insertion direction F1, the receiving sections 19*b*, 19*c*, and 19*d* are linear, while the receiving section 19*a* is a circular-arc shape. In other words, the receiving section 19*a* is a concave relief section that is depressed outside or in the direction of the outer periphery of the cap 10 and has a shape corresponding to the extension 39*a* (the first extension) of the case body 30. In the attached state, the leading edges of the extensions 39*a*, 39*b*, 39*c*, and 39*d* are fitted to the receiving sections 19*a*, 19*b*, 19*c*, and 19*d*, respectively. In other words, the engagement-piece receiving portion 19 abuts, over its entire periphery, against the first engagement piece 39, thus contributing to ensuring the sealing ability.

Next, the shape of the first engagement piece 39, particularly the shape of the extension 39*a*, will be described in detail. As illustrated in FIG. 4A, suppose that the extension 39*a* extends from one end position P1 to the other end position P2 in the direction parallel to the center of turning C1. The length L of the extension 39*a* in the direction parallel to the center of turning C1 (the direction of the center of turning or the center-of-turning direction) decreases toward the end of the extension 39*a* in the extension direction (upward). Because the leading edge of the extension 39*a* is circular-arc-shaped, the length L gradually shortens toward the end of the extension 39*a*.

The middle position of the extension 39*a* in the center-of-turning direction is P0. Viewed from the insertion direction F1, the leading edge of the extension 39*a* includes chamfers 39*a*1 and 39*a*2 on both sides of the middle position P0, which are chamfered sections angled with respect to the center of turning C1. The chamfers 39*a*1 and 39*a*2 are both circular-arc-shaped sections.

Figure 5A:
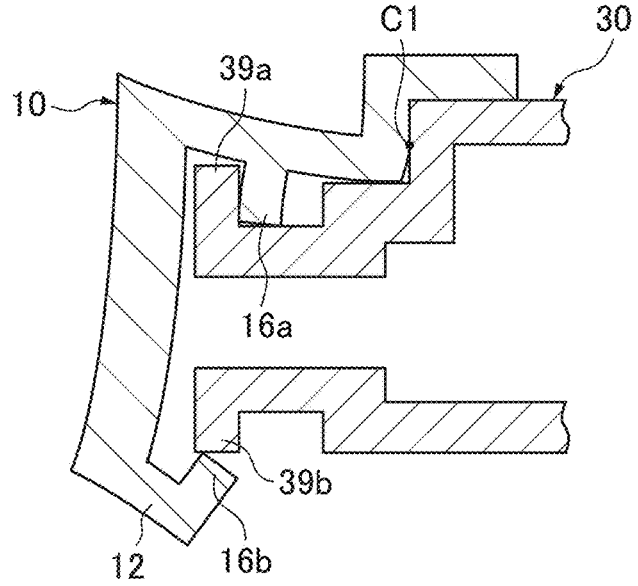
FIGS. 5A to 5C are diagrams illustrating the process of detaching the cap from the case body.
Figure 5B:
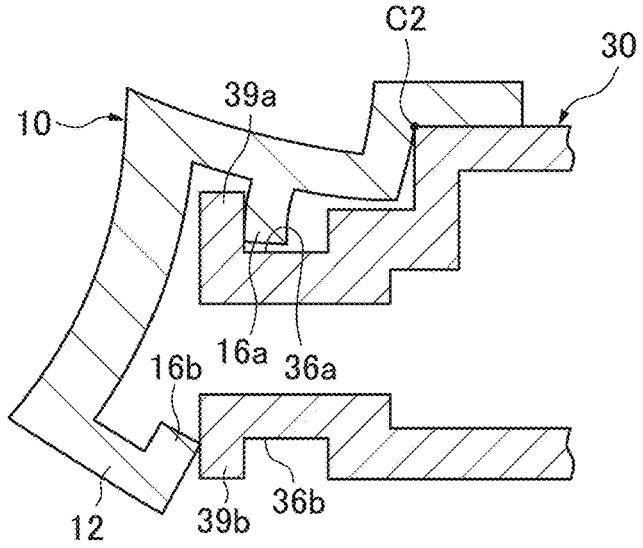
Figure 5C:
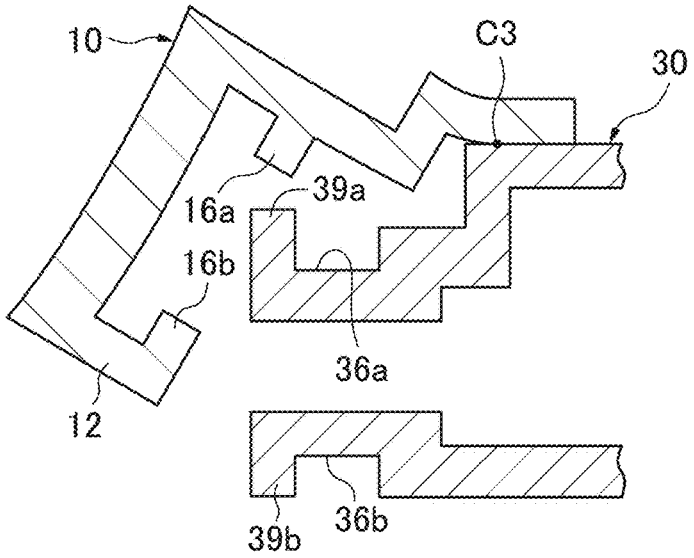

FIGS. 5A to 5C are diagrams illustrating the process of detaching the cap 10 from the case body 30. It should be noted that the state of the cap 10 attached to the case body 30 is as illustrated in FIG. 1. In the attached state, in the direction perpendicular to the insertion direction F1, the second engagement piece 16 is fitted to the fitting portion 36, and the first engagement piece 39 is fitted to the engagement-piece receiving portion 19. Moreover, in the attached state, the first engagement piece 39 engages with the second engagement piece 16 in the insertion direction F1. It should be noted that the first engagement piece 39 may also be sandwiched by the second engagement piece 16 and the bottom wall portion 11. This structure protects the connection terminal 34, and tightly seals the case body 30, to also provide waterproofing and dustproofing functions.

When detaching the cap 10, a user first grasps the bottom of the peripheral wall portion 12 to disengage the extension 16*b* from the extension 39*b* (FIG. 5A). At such time, the cap 10 turns about the center of turning C1. The extension 16*a* (the second extension) is engaged with the extension 39*a* (the first extension), and the end of the extension 16*a* abuts against or is slightly spaced apart from the first surface 36*a*. It should be noted that the extension 39*a* (the first extension) is one of extensions of the first engagement piece 39, corresponding to or facing the side closest to the center of turning C1, among the four sides of the substantially rectangular outer shape of the fitting portion 36; and the extension 16*a* (the second extension) is one of extensions of the second engagement piece 16, corresponding to or facing the side closest to the center of turning C1 in the attached state.

It should be noted that the cap 10 is capable of turning about the case body 30 with the center of turning C1 serving as the center, but the effective center of turning can change during the processes of attaching and detaching the cap. This is because the cap 10 is highly elastic, and the bottom of the peripheral wall portion 12, and the extension 16*b* are primarily manipulated. Although the centers of turning C1 to C3 illustrated in FIGS. 5A to 5C are the assumed possible centers of turning, the centers of turning can change depending on a mode of the manipulation.

Next, the user further turns the bottom of the peripheral wall portion 12 and completely removes the extension 16*b* from the extension 39*b* (FIG. 5B). At this point, the extension 16*a* is spaced apart from the first surface 36*a*. However, since the extension 16*a* is still engaged with the extension 39*a*, the extension 16*a* stretches and bends a little due to elastic deformation. Next, when the bottom of the peripheral wall portion 12 is turned further, the extension 16*a* is removed from the extension 39*a* (FIG. 5C).

Here, unless configured with some kind of ingenuity, the extension 16*a* will undergo significant elastic deformation in the step illustrated in FIG. 5B through repeated usage, and there is a risk of damage primarily near the root of the extension 16*a*. It should be noted that the forces applied to the cap 10 are different when the cap 10 is attached and when same is detached, and hence the mode of elastic deformation is also different. Since the extension 16*a* is subjected to a large amount of stress primarily during the detachment, this embodiment places emphasis on reducing damage during the detachment. In this embodiment, the leading edge of the extension 39*a* is circular-arc-shaped to reduce the damage to the extension 16*a* and improve the durability of the cap 10.

The effect of ingenuity of shape will now be described. In general, if a large amount of stress is applied to the extension 16*a* all at once at the moment when the extension 16*a* is disengaged from the extension 39*a*, the damage will be significant. However, in this embodiment, the extension 39*a* includes chamfers 39*a*1 and 39*a*2. Therefore, the state of engagement between the extension 16*a* and the extension 39*a* is gradually cancelled during the process of detaching the cap 10. Moreover, the entire leading edge of the extension 39*a* is circular-arc-shaped, and hence the engagement between same and the extension 16*a* is gradually released until the extension 16*a* is completely removed from the extension 39*a*. Thus, the amount of stress on the extension

16*a* at the moment the extension 16*a* is disengaged from the extension 39*a* is reduced. Therefore, the occurrence of damage to the extension 16*a* is suppressed, and the durability of the cap 10 is improved. It should be noted that such action is also the same even from the standpoint of the extension 39*a*. In other words, even if the extension 39*a* were formed using a material that is more highly elastic than the extension 16*a*, the amount of stress on the extension 39*a* at the moment the extension 39*a* is disengaged from the extension 16*a* would be smaller. Therefore, damage to the extension 39*a* is suppressed, and the durability of the case body 30 is improved. As a result, according to the present invention, the durability of an electrical connection part provided with the cap 10 and the case body 30 can be improved.

According to this embodiment, the opening 33 is substantially rectangular, and the outer shape of the fitting portion 36 formed around the opening 33 is also substantially rectangular. This means that there is no need to make the profiles of the case body 30 and cap 10 circular. Therefore, the outer shape of the fitting portion 36 has smaller outer dimensions than if same were circular or another shape. Furthermore, the length L of the extension 39*a* in the direction parallel to the center of turning C1 decreases toward the end of the extension 39*a* in the extension direction. As a result, the engagement between the extension 16*a* and the extension 39*a* is gradually released when the cap 10 is detached from the case body 30. Therefore, because a large amount of stress is not generated in the extension 16*a* primarily during the detachment, damage to the extension 16*a* due to repeated use can be suppressed. Thus, the durability of the electrical connection part 100 can be improved and an increase in size thereof can be avoided.

In addition, the cap 10 includes a receiving section 19*a* as a concave relief section that is depressed outside or in the direction of the outer periphery of the cap 10, and in the attached state, the end of the extension 39*a* in the extension direction is fitted to the receiving section 19*a*. The extension 39*a* is thus prevented from being too long and bending in the attached state, thereby suppressing a drop in the sealing ability.

Figure 6A:
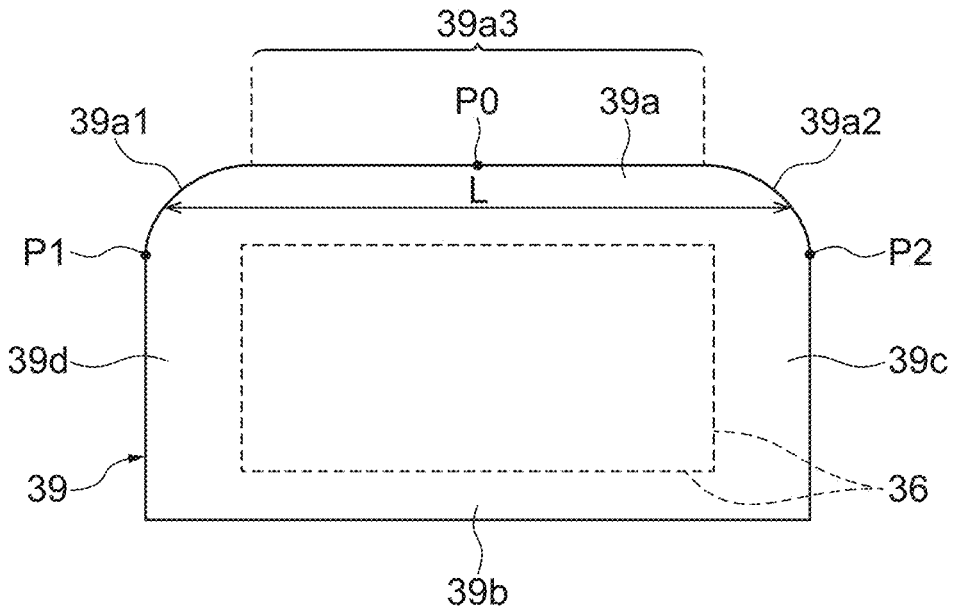
FIGS. 6A and 6B are front views of first engagement pieces according to variations.
Figure 6B:
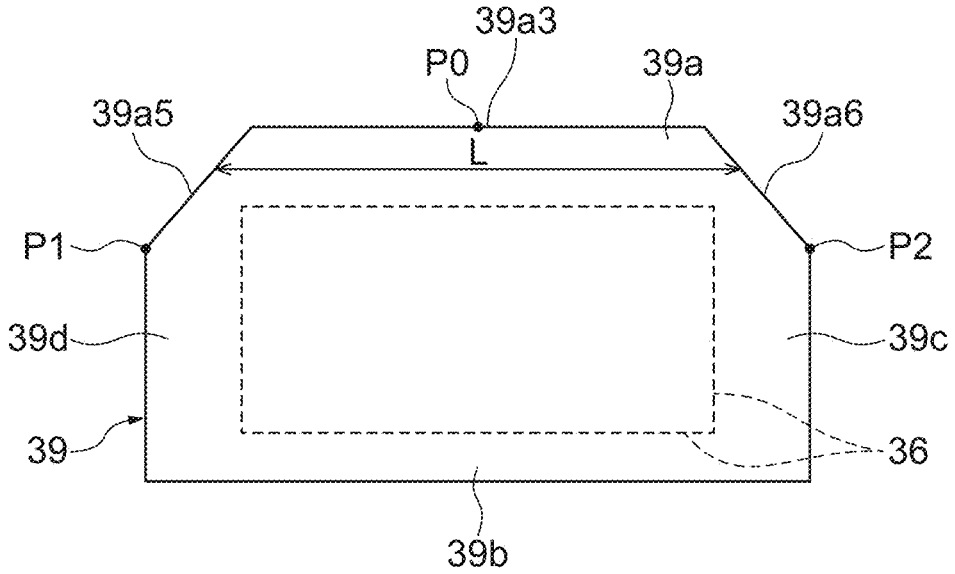

FIGS. 6A and 6B are front views of first engagement pieces 39 according to variations. The shape of the first engagement piece 39, especially of the extension 39*a*, may be modified as illustrated in FIGS. 6A and 6B. From the viewpoint of preventing a large amount of stress from being generated in the extension 16*a* during the detachment, the length L of the extension 39*a* in the direction parallel to the center of turning C1 should fulfill the first condition of decreasing toward the end of the extension 39*a* in the extension direction. Alternatively, the end of the extension 39*a* in the extension direction should fulfill the second condition of having chamfers, which are chamfered sections angled with respect to the center of turning C1 when viewed from the insertion direction F1, located in the area from the middle position P0 and to the end position P1 and the area from the middle position P0 to the end position P2, respectively, both extending in the direction of the center of turning C1. In other words, the foregoing first condition and/or second condition should be fulfilled. Both variations illustrated in FIGS. 6A and 6B fulfill both of the foregoing first and second conditions.

For instance, in the example illustrated in FIG. 6A, viewed from the insertion direction F1, the end of the extension 39*a* in the extension direction includes a linear section 39*a*3 that is substantially parallel to the center of turning C1, and further includes chamfers 39*a*1 and 39*a*2, which are circular arcs on both sides of the linear section 39*a*3 in the center of turning C1 direction. In the example illustrated in FIG. 6B, viewed from the insertion direction F1, the end of the extension 39*a* in the extension direction includes chamfers 39*a*5 and 39*a*6, which are linear sections formed in a tapered or linearly chamfered shape on both sides of the linear section 39*a*3 in the center of turning C1 direction. In this example, viewed from the insertion direction F1, the extension 39*a* is substantially trapezoidal. It should be noted that, viewed from the insertion direction F1, the extension 39*a* may also be triangular. Thus, the chamfers may also have a circular-arc shape or a curved shape.

According to the first embodiment, the extension 39*a* of the first engagement piece 39 of the case body 30 fulfills the foregoing first and second conditions. In contrast, according to a second embodiment of the present invention, the extension 16*a* of the second engagement piece 16 of the cap 10 is configured to fulfill the foregoing first and/or second condition. Features that differ from the first embodiment will primarily be described.

Figure 7:
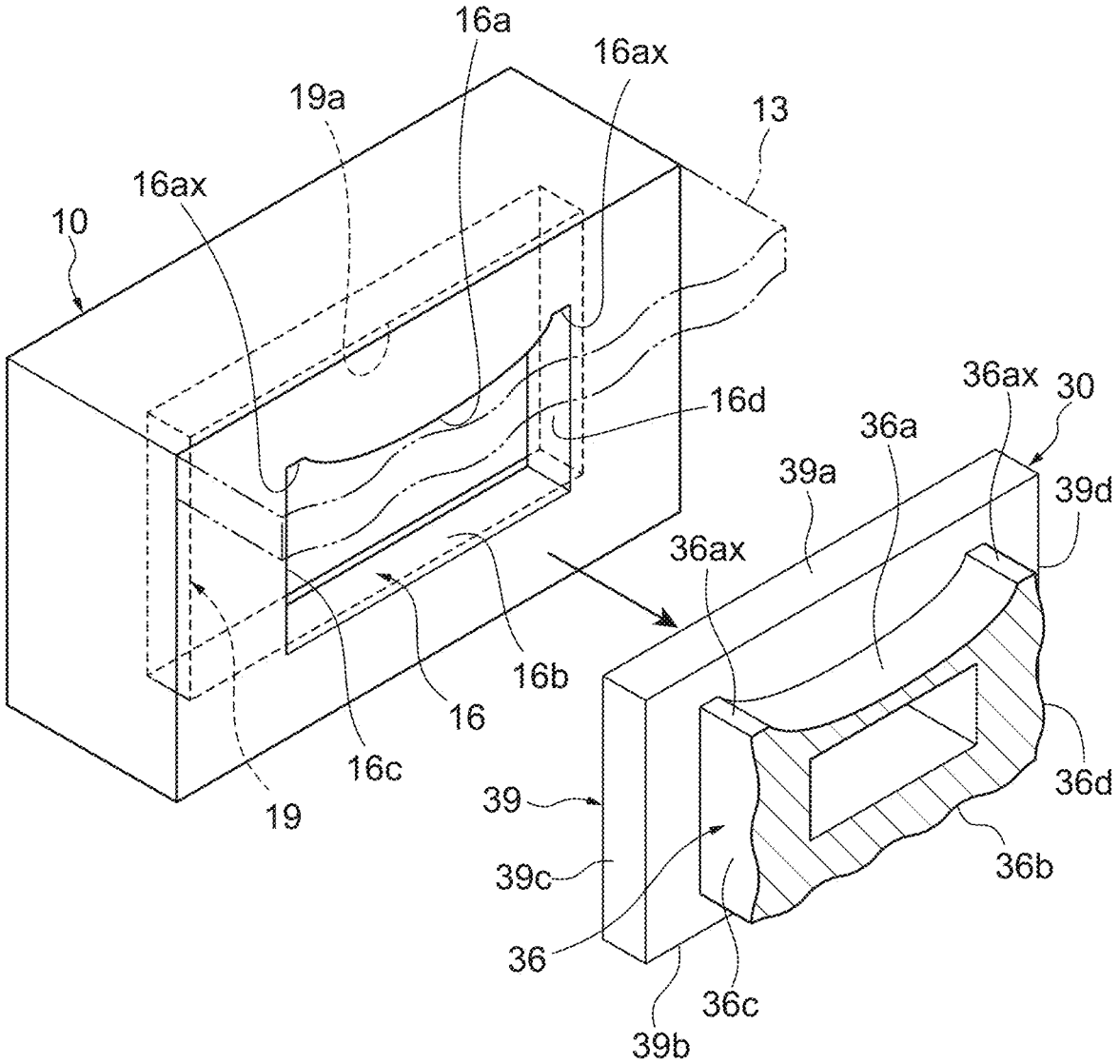
FIG. 7 is a perspective view in which a cap and a case body according to a second embodiment are separate.

FIG. 7 is a perspective view in which the cap 10 and the case body 30 according to this embodiment are separate. First, viewed from the insertion direction F1, not only the extensions 39*b*, 39*c*, and 39*d* of the case body 30, but also the leading edge of the extension 39*a* (the end in the extension direction), are linear. Meanwhile, with regard to the engagement-piece receiving portion 19 inside the cap 10, the holes formed by the receiving sections 19*a*, 19*b*, 19*c*, and 19*d* have a rectangular shape that fits the first engagement piece 39. Therefore, viewed from the insertion direction F1, not only the receiving sections 19*b*, 19*c*, and 19*d*, but also the receiving section 19*a*, are linear.

Furthermore, the first surface 36*a* constitutes the side (upper side) closest to the center of turning C1 among the four sides of the substantially rectangular outer shape of the fitting portion 36 of the case body 30, and the first surface 36*a* is not linear or flat but curved. In other words, the fitting portion 36 includes a first surface 36*a* as a concave relief section that is depressed inside or in the direction of the inner periphery of the case body 30 and has a shape corresponding to the extension 16*a* (the second extension) of the cap 10. However, the open shape formed by the extensions 16*a*, 16*b*, 16*c*, and 16*d* of the cap 10 is a shape that fits the outer shape of the fitting portion 36. The shape of the end of the extension 16*a* in the extension direction is the same as the end shape of the extension 39*a* (FIG. 4A) according to the first embodiment. Thus, in the attached state, the ends of the extensions 16*a*, 16*b*, 16*c*, and 16*d* abut against the surfaces 36*a*, 36*b*, 36*c*, and 36*d*, respectively. In the attached state in particular, the end of the extension 16*a* in the extension direction is fitted to the first surface 36*a*. That is, the second engagement piece 16 abuts, over its entire periphery, against the fitting portion 36. It should be noted that, by considering the sealing ability of the cap 10, the second engagement piece 16 and the fitting portion 36 need not abut against each other over their entire periphery.

It should be noted that flat sections 36*ax* that are substantially parallel to the center of turning C1 are provided at both ends of the first surface 36*a*. Correspondingly, flat sections 16*ax* that are substantially parallel to the center of turning C1 is provided at both ends of the extension 16*a*. The presence of the flat sections 16*ax* enhances the strength of the extension 16*a* because the boundary between the extension 16*a*, which is a substantially circular arc section, and the extensions 16*b* and 16*c* does not have a sharp acute angle. However, the flat sections 36*ax* and the flat sections 16*ax* are not essential.

Also in the case of the configuration of this embodiment, when the cap 10 is detached from the case body 30, the engagement between the extension 16*a* and the extension 39*a* is gradually released. Thus, this embodiment affords the same advantageous effects as the first embodiment in terms of improving the durability of the electrical connection part 100 and avoiding an increase in size thereof.

It should be noted that, according to this embodiment, even if the extension 16*a* is longer than the depth of the first surface 36*a*, the extension 16*a* may bend in the attached state such that the end of the extension 16*a* does not abut against the first surface 36*a*.

It should be noted that, also according to this embodiment, the shapes as per the variations (FIGS. 6A and 6B) may also be adopted for the extension 16*a* of the second engagement piece 16. Since it is only necessary for at least one of the extension 39*a* of the first engagement piece 39 or the extension 16*a* of the second engagement piece 16 to fulfill the foregoing first condition and/or second condition, both the extension 39*a* and the extension 16*a* may also fulfill the foregoing first condition and/or second condition.

Although the present invention has been described in detail hereinabove on the basis of preferred embodiments, the present invention is not limited to or by these specific embodiments and may also include various modifications falling within a scope not departing from the spirit of the invention. Portions of the foregoing embodiments may also be suitably combined.

This application claims the benefit of Japanese Patent Application No. 2020-127297 filed on Jul. 28, 2020 which is hereby incorporated by reference herein in its entirety.

What is claimed is:

1. A fitting structure for an electrical connection part, comprising:

a case body that houses a connection terminal and that comprises a substantially rectangular opening for a connection of an external connection terminal to the connection terminal; and a cap that covers the opening in a state of being attached to the case body and that is connected to the case body attachably to and detachably from the case body so as to be turnable about a center of turning which extends substantially perpendicular to an insertion direction in which the external connection terminal travels toward the connection terminal, wherein the case body further comprises:

a fitting portion that is formed around the opening to enable the cap to be fitted and has a substantially rectangular outer shape when the opening is viewed from the front; and a first engagement piece that extends from the fitting portion in a direction of an outer periphery of the case body, to be substantially perpendicular to the insertion direction, wherein the cap further comprises a second engagement piece that extends in a direction of an inner periphery of the cap to engage with the first engagement piece, wherein the first engagement piece comprises a first extension corresponding to a side closest to the center of turning among four sides of the substantially rectangular outer shape of the fitting portion, wherein the second engagement piece comprises a second extension corresponding to the side closest to the center of turning in a state the cap being attached to the case body, and wherein the length of at least one of the first extension or the second extension in a direction of the center of turning decreases toward an end of the at least one of the first extension or the second extension in an extension direction in which the at least one of the first extension or the second extension extends.

2. The fitting structure for an electrical connection part according to claim 1, wherein the at least one of the first extension or the second extension includes the first extension, the cap comprises a relief section that is depressed in a direction of an outer periphery of the cap, and the relief section has a shape corresponding to the first extension.

3. The fitting structure for an electrical connection part according to claim 1, wherein the at least one of the first extension or the second extension includes the second extension, the fitting portion comprises a relief section that is depressed in a direction of an inner periphery of the case body, and the relief section has a shape corresponding to the second extension.

4. A fitting structure for an electrical connection part, comprising:

a case body that houses a connection terminal and that comprises a substantially rectangular opening for a connection of an external connection terminal to the connection terminal; and a cap that covers the opening in a state of being attached to the case body and that is connected to the case body attachably to and detachably from the case body so as to be turnable about a center of turning which extends substantially perpendicular to an insertion direction in which the external connection terminal travels toward the connection terminal, wherein the case body further comprises:

a fitting portion that is formed around the opening to enable the cap to be fitted and has a substantially rectangular outer shape when the opening is viewed from the front; and a first engagement piece that extends from the fitting portion in a direction of an outer periphery of the case body, to be substantially perpendicular to the insertion direction, wherein the cap further comprises a second engagement piece that extends in a direction of an inner periphery of the cap to engage with the first engagement piece, wherein the first engagement piece comprises a first extension corresponding to a side closest to the center of turning among four sides of the substantially rectangular outer shape of the fitting portion, wherein the second engagement piece comprises a second extension corresponding to the side closest to the center of turning in a state the cap being attached to the case body, and wherein at least one of the first extension or the second extension comprises chamfers located in in an area from a middle position to one end position of the at least one of the first extension or the second extension and in an area from the middle position to the other end position of the at least one of the first extension or the second extension, both extending in the direction of the center of turning.

5. The fitting structure for an electrical connection part according to claim 4, wherein the chamfers have a circular-arc shape or a curved shape.

6. The fitting structure for an electrical connection part according to claim 4, wherein the at least one of the first extension or the second extension includes the first extension, the cap comprises a relief section that is depressed in a direction of an outer periphery of the cap, and the relief section has a shape corresponding to the first extension.

7. The fitting structure for an electrical connection part according to claim 4, wherein the at least one of the first extension or the second extension includes the second extension, the fitting portion comprises a relief section that is depressed in a direction of an inner periphery of the case body, and the relief section has a shape corresponding to the second extension.

* * * * *